US007252078B2

(12) United States Patent
Kraus et al.

(10) Patent No.: US 7,252,078 B2
(45) Date of Patent: Aug. 7, 2007

(54) SPARK PLUG CONNECTOR

(75) Inventors: Markus Kraus, Wiesing (AT); Arno Gschirr, Innsbruck (AT); Markus Kröll, Ginzling (AT)

(73) Assignee: GE Jenbacher GmbH & Co oHG, Jenbach (AT)

( * ) Notice: Subject to any disclaimer, the term of this patent is extended or adjusted under 35 U.S.C. 154(b) by 0 days.

(21) Appl. No.: 11/224,656

(22) Filed: Sep. 11, 2005

(65) Prior Publication Data

US 2006/0089024 A1 Apr. 27, 2006

(30) Foreign Application Priority Data

Oct. 22, 2004 (AT) ..... A 1786/2004

(51) Int. Cl.
*F02P 11/00* (2006.01)
*H01R 13/44* (2006.01)

(52) U.S. Cl. ..... 123/633; 123/620; 439/125

(58) Field of Classification Search ..... 123/633, 123/634, 635, 605, 606, 607, 608, 169 PA, 123/169 PH, 169 CB, 609, 620; 439/125, 439/126, 271; 315/224
See application file for complete search history.

(56) References Cited

U.S. PATENT DOCUMENTS

| | | | | |
|---|---|---|---|---|
| 3,178,661 | A | 4/1965 | Kirchgessner | 333/182 |
| 3,882,341 | A * | 5/1975 | Green | 313/134 |
| 4,787,360 | A * | 11/1988 | Filippone | 123/406.66 |
| 6,374,816 | B1 * | 4/2002 | Funk et al. | 123/605 |
| 6,463,918 | B1 * | 10/2002 | Moga et al. | 123/633 |

FOREIGN PATENT DOCUMENTS

| | | |
|---|---|---|
| DE | 94 06 689 | 4/1994 |
| DE | 195 22 657 A1 | 6/1995 |
| DE | 101 54 798 | 5/2003 |
| FR | 1 279 413 | 4/1962 |
| FR | 2 225 857 | 11/1974 |

* cited by examiner

*Primary Examiner*—Willis R. Wolfe
*Assistant Examiner*—Johnny H. Hoang
(74) *Attorney, Agent, or Firm*—Wenderoth, Lind & Ponack, L.L.P.

(57) ABSTRACT

A spark plug connector, in particular for large engines, includes an inductive interference suppression device having a ferromagnetic core. The inductive interference suppression device also has at least one winding, preferably a coil, and an ohmic d.c. resistance of at least 20Ω at 20° C.

27 Claims, 4 Drawing Sheets

SPARK PLUG CONNECTOR

CROSS-REFERENCE TO RELATED APPLICATIONS

This application claims foreign priority benefits under 35 USC 119(a)-(d) or (f), or 365(b), of Austrian Application No. A 1786/2004, filed Oct. 22, 2004, the contents of which are herein incorporated by reference in their entirety.

BACKGROUND

The present invention relates to a spark plug connector, in particular for large engines such as large gas engines.

Spark plug connectors form a substantially rigid connection between spark plugs, which primarily in the case of large engines are recessed deep into bores in the engine block, and the spark plug leads which lead to at least one ignition coil. They may attain a length of more than half a meter. Their rigidity is selected such that, on the one hand, it is readily possible to push them onto the spark plug, preferably without the need for further tools, while on the other hand, the spark plug connectors typically have a certain residual flexibility. Thus, in most cases, they are not completely rigid.

It is furthermore known from the prior art that ohmic resistor elements can be used to suppress interference in ignition systems. The disadvantage of these interference suppression resistors is that they consume an unnecessarily high quantity of useful energy in order to damp the radio frequency disturbance. This lost energy must on the one hand be made available by the ignition system and on the other hand results in the components concerned, such as the spark plug connector, becoming hot. This heating is highly problematic since, as a result of the electrical insulation resistance demanded among other things of the spark plug connector, materials which may also be poor heat conductors are used. This problem becomes particularly acute if—as is conventional with large engines—ignition systems which generate very high levels of ignition power are employed.

SUMMARY OF THE INVENTION

The object of the invention is to provide a spark plug connector which helps to eliminate the problems described above.

In accordance with the invention, this is achieved with a spark plug connector, in particular for large engines, with an inductive interference suppression device which has a ferromagnetic core with at least one winding, preferably a coil, and an ohmic d.c. (direct current) resistance of at least 20Ω at 20° C.

The use of an inductive interference suppression device according to the invention, instead of the sole use of an ohmic d.c. resistor, significantly improves the energy balance, since the interference suppression device can be configured such that it presents a high resistance to high frequencies and, at the same time, a very low resistance to the lower-frequency useful energy. To achieve optimum interference suppression behavior, the inductance of the winding or coil is used in conjunction with the ohmic d.c. resistor. To achieve sufficient inductance, a winding with a ferromagnetic core must be used. In order for the overall shape to be kept as small as possible, the winding or coil may have a resistor wire to provide the ohmic d.c. resistance. A preferred embodiment provides for the ferromagnetic core to be made from a material which is not electrically conductive, or has very high resistance. An electrically non-conductive ferrite core and a specific d.c. resistance for the interference suppression device of at least 100Ω, preferably at least 500Ω, at 20° C., are particularly advantageous.

BRIEF DESCRIPTION OF THE DRAWINGS

Further details and advantages of the present invention will emerge from the description below of the drawings, in which.

DETAILED DESCRIPTION OF THE INVENTION

Figure 1:
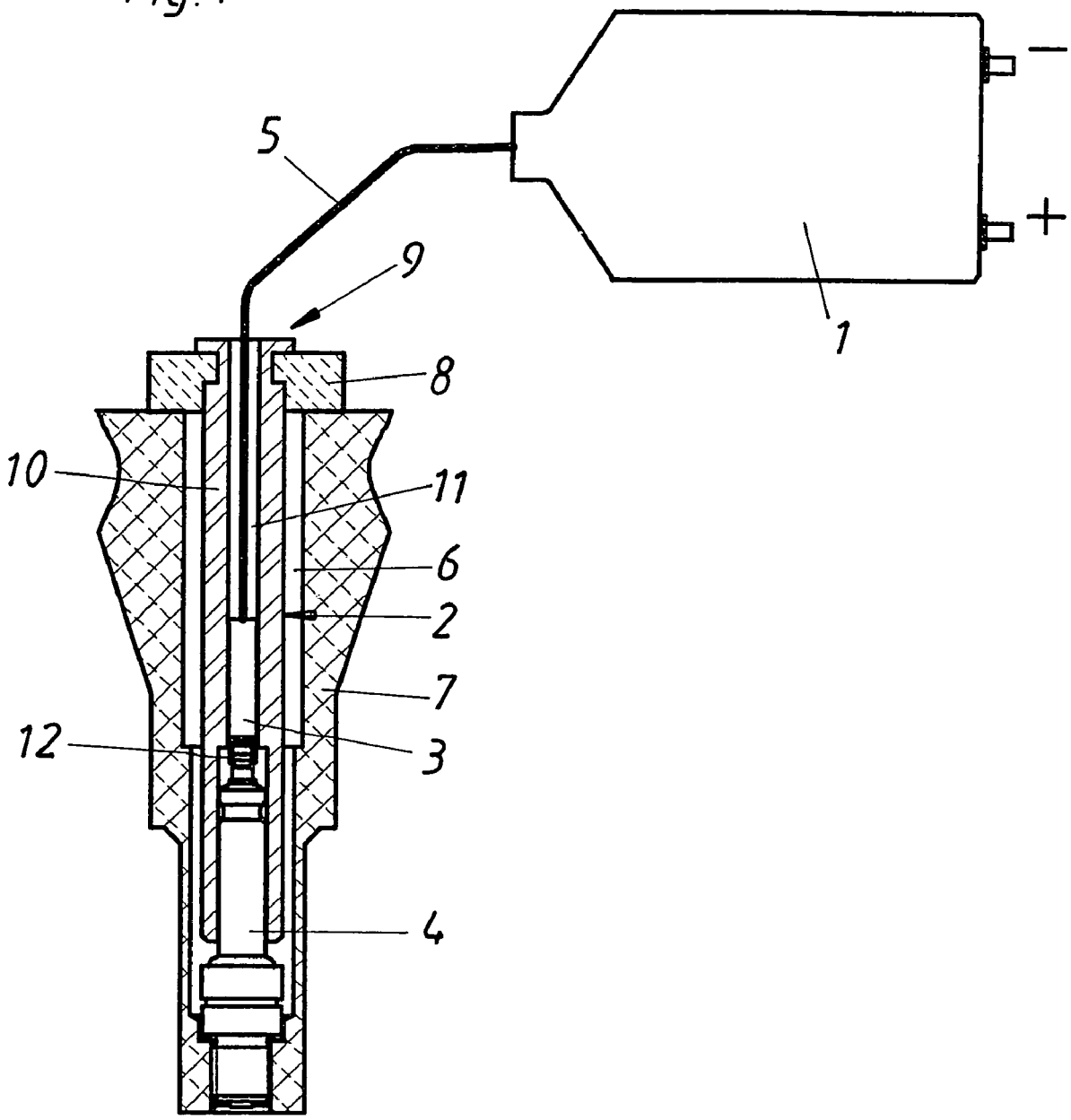
FIG. 1 is a partial sectional view illustrating an example embodiment, in accordance with the invention, of a spark plug connector.

FIG. 1 shows a structure, in accordance with the invention, in a diagrammatic sectional illustration. The ignition coil 1 is illustrated in a highly simplified manner and may be constructed as known from the prior art. A spark plug lead 5 leads from the ignition coil 1 into the spark plug connector 2, which is arranged in a bore 6 in the engine block 7 and is pushed onto a spark plug 4. Conventionally, there is a plug contact on the end of the spark plug connector 2 remote from the spark plug 4, and the plug contact serves to connect the spark plug 4 to an external spark plug lead cable 5. This detail is not illustrated here, but may be constructed as known from the prior art. Preferably, the spark plug connector is a separate component from the ignition coil 1. As a result of this, unnecessary loads on the ignition coil arising from vibration and heat are avoided, since the ignition coil can be arranged at a remote location, connected to the spark plug connector 2 by way of the spark plug lead 5.

Figure 2:
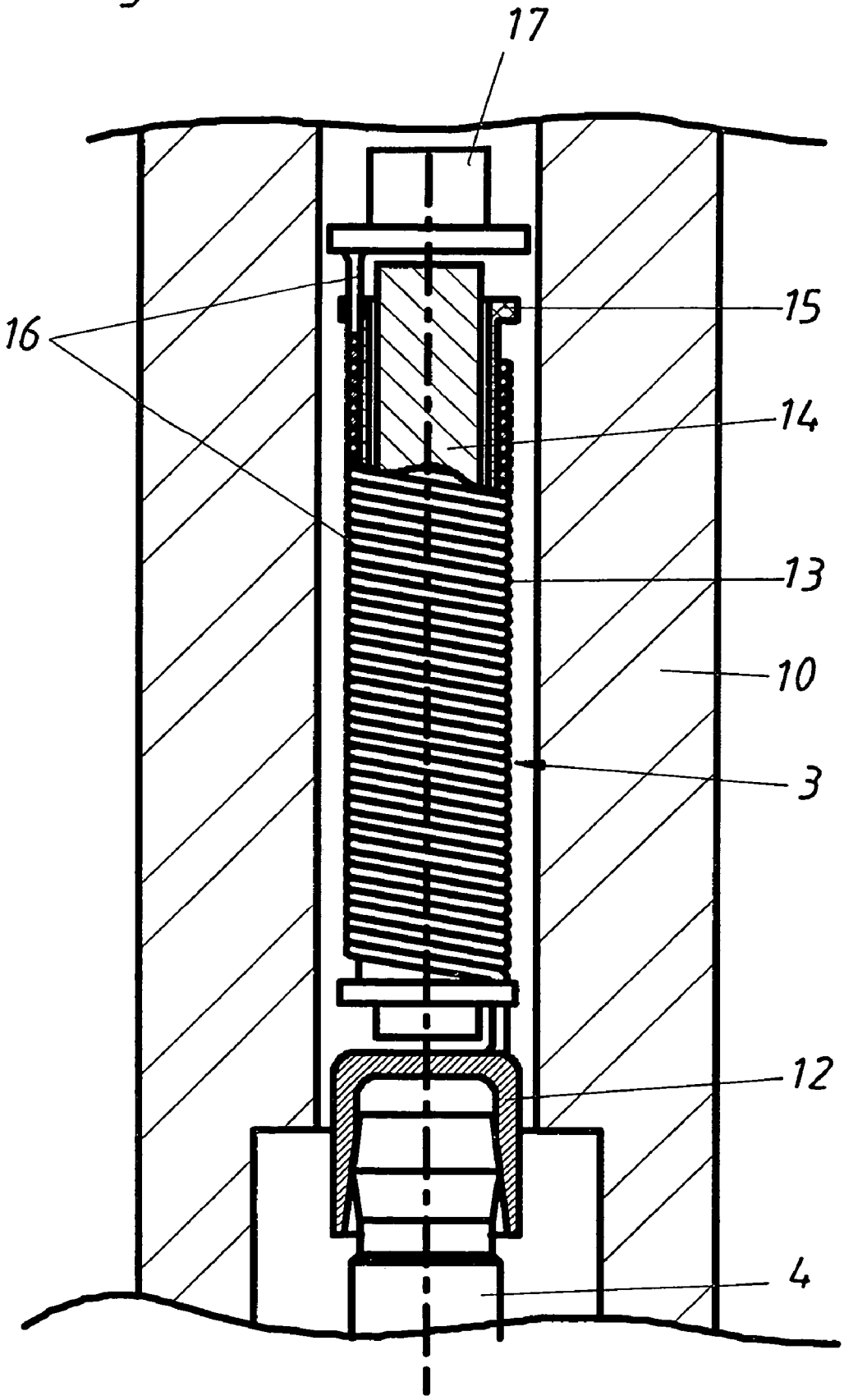
FIG. 2 a partial sectional view of a region of the spark plug connector from FIG. 1, in the region of the inductive interference suppression device.
Figure 3:
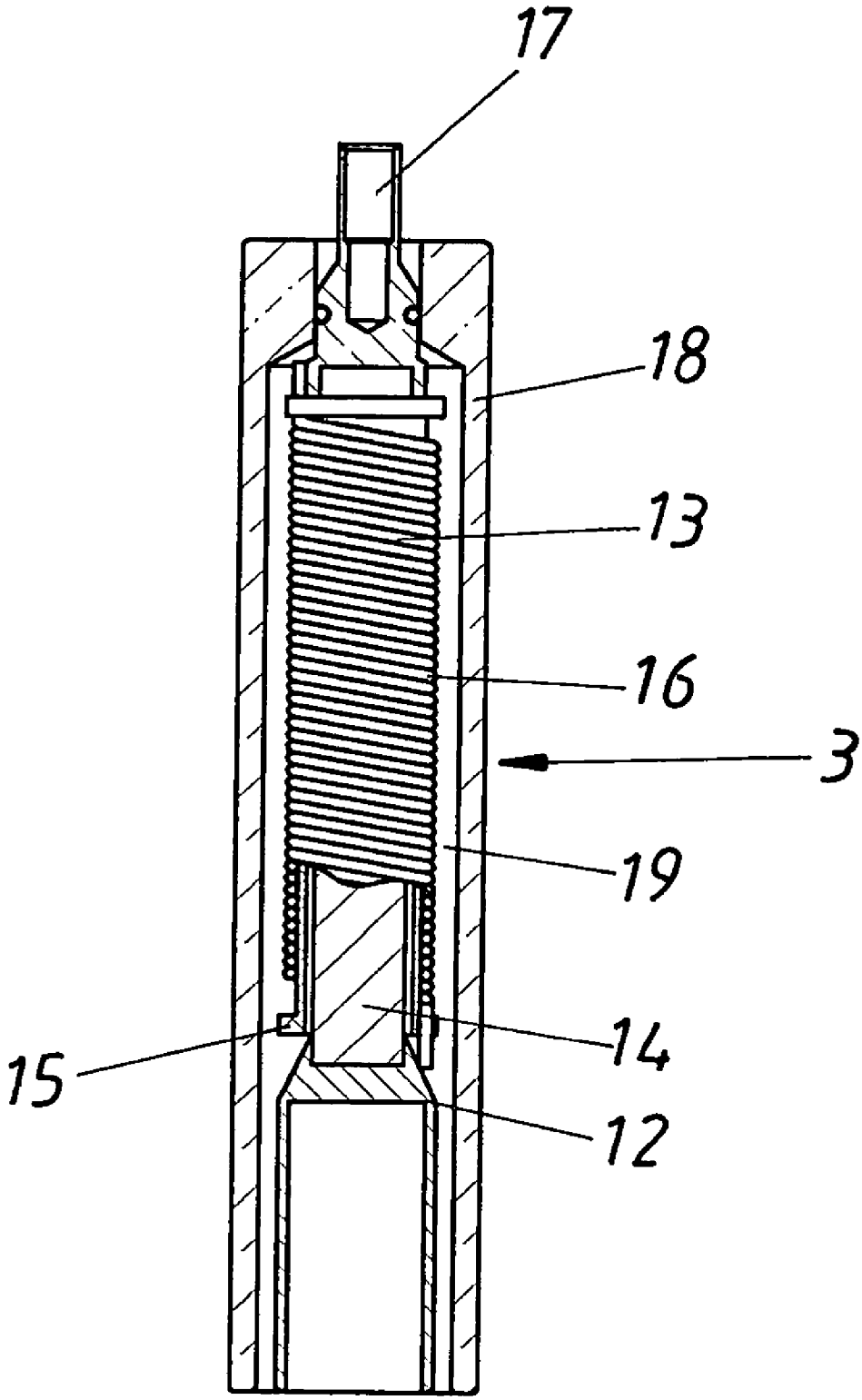
FIG. 3 is a partial sectional view of a variant embodiment of the inductive interference suppression device, surrounded by a ceramic element.

The spark plug connector 2 has a support 10 made from polytetrafluoroethylene, with a central bore 11. The spark plug lead 5 is guided inside the support 10 of the spark plug connector 2 through this bore 11 to an inductive interference suppression device 3. As illustrated, the spark plug connector 2 is pushed onto the spark plug 4, as known from the prior art, making an electrical contact by way of the terminal contact 12. In particular, as shown in FIG. 1, an end of the support 10 is shaped to fit onto the spark plug 4 so as to connect the spark plug connector 2 to the spark plug 4. The support 10, substantially intrinsically rigid, of the spark plug connector makes it possible for pushing the spark plug connector 2 onto the spark plug 4 to be sufficient to secure the connector to the spark plug 4. In addition, however, a fixing device 8 which secures the spark plug connector 2 to the engine block 7 may also be provided. For this purpose, screw, plug or other types of clamping connections may be provided. To obtain the maximum effect of the inductive interference suppression device 3 with a minimum loss, the interference suppression device 3 should be mounted as close as possible to the main source of interference. In this case, the source of interference is spark-over at the electrodes of the spark plug 4. Because it is impossible in practice to arrange the inductive interference suppression device 3 in the spark plug, for mechanical and thermal reasons, also taking into account the overall size of the inductive interference element 3, the inductive interference suppression device 3 should be electrically connected as close as possible, preferably substantially directly, to the terminal contact 12. This is shown in FIGS. 2 and 3. The inductive interference suppression element 3 suppresses interference on the entire spark plug lead 5 on the side of the device 3 remote from the spark plug. This is particularly advantageous in the case of remotely arranged ignition coils, since otherwise the spark plug leads 5, which primarily in the case of large engines are very long, would act as antennae for the interference signals produced by the spark plug.

The inductive interference suppression device 3 should in principle be configured such that interference primarily in the frequency range between 1 MHz and 1 GHz, preferably between 30 MHz and one GHz, is suppressed particularly effectively. For this purpose, it is advantageous for the inductive interference suppression device to have an inductance of between 200 μH and 500 μH, preferably between 300 μH and 400 μH. The electric strength of the spark plug connector 2 overall should be more than 10 kV, preferably more than 30 kV. Together with the ohmic d.c. resistors of the inductive interference suppression device 3 that have already been described above, this makes it possible to transmit high levels of ignition power with very low losses and hence very low heat generation. In practice, levels of ignition power of more than 200 mJ to 1 J at an ignition rate, or a number of ignitions per unit of time, of 12.5 Hz to 15 Hz can be transmitted without problems. When resistor wire is used, the latter may preferably be made from a nickel chromium alloy. Examples of such alloys are sold under the trade name ISA-CHROM.

Advantageous variants on the spark plug connector include providing a length of at least 10 cm, preferably between 40 cm and 70 cm. In relation to the position of the inductive interference suppression device 3, however, the end of the spark plug connector 2 remote from the terminal contact 12 may be at least 10 cm, preferably between 40 cm and 70 cm, away from the end of the inductive interference suppression device 3 which is remote from the terminal contact 12.

FIG. 2 shows in detail the inductive interference suppression device 3 which was illustrated only diagrammatically in FIG. 1. Advantageously, it has a maximum length of 80 mm and a maximum diameter of 12 mm. In the example shown, a winding 13 made from resistor wire 16 is arranged around a ferromagnetic core 14, for example made from electrically non-conductive ferrite. In FIG. 2, the core and winding are shown in a sectional illustration in the upper region and in a side view in the lower region. Instead of the resistor wire 16, ordinary wire having a relatively low ohmic resistance can also be used if an additional ohmic resistor component is then connected in series with the winding 13. The winding 13 is wound onto an additional winding support 15 in the example embodiment shown. However, the winding support is may also be omitted from other example embodiments. In these cases, the winding 13 of the wire or the resistor wire is wound directly onto the core 14. The appropriate selection of the material of the core 14 and the insulation of the wire or resistor wire may, here too, have the result of achieving an electric strength in the spark plug connector 2 of more than 10 kV, preferably more than 30 kV, preferably between both terminals 17 and 12. For this variant, high-resistance ferrite cores are particularly suitable. In all cases, it is advantageous if the core 14 is arranged on the inside of the winding 13. For the reasons stated above, it is preferable to arrange the terminal contact 12 for connection to the spark plug 4 directly at the lower end of the winding 13. At the opposite end of the winding 13, there is provided a plug, clamping or screw device 17 which serves to make contact with the spark plug lead 5. Here, connections which may be made by pushing the spark plug leads 5 into the central bore 11 and which thereafter are preferably not detachable again are advantageous. Alternatively, however, it may also be provided for the spark plug lead 5 to be directly connected to the resistor wire 16, in which case the terminal component 17 can be dispensed with. The inductive interference suppression element 3, like the spark plug lead 5, may be clamped inside the central bore 111 of the support 10 or indeed encapsulated therein.

FIG. 3 shows a further variant on the interference suppression device 3. This has a ceramic element 18 which surrounds the ferromagnetic core 14, the winding 13 with the ohmic d.c. resistor, and in this example embodiment, the terminal contact 12 as well. If the example embodiment according to FIG. 3 is integrated inside the spark plug connector, the support 10 in turn surrounds the ceramic element 18. The space between the winding 13 and the ceramic element 3 may be filled, for example, with an encapsulating polyester resin or the like.

Figure 4:
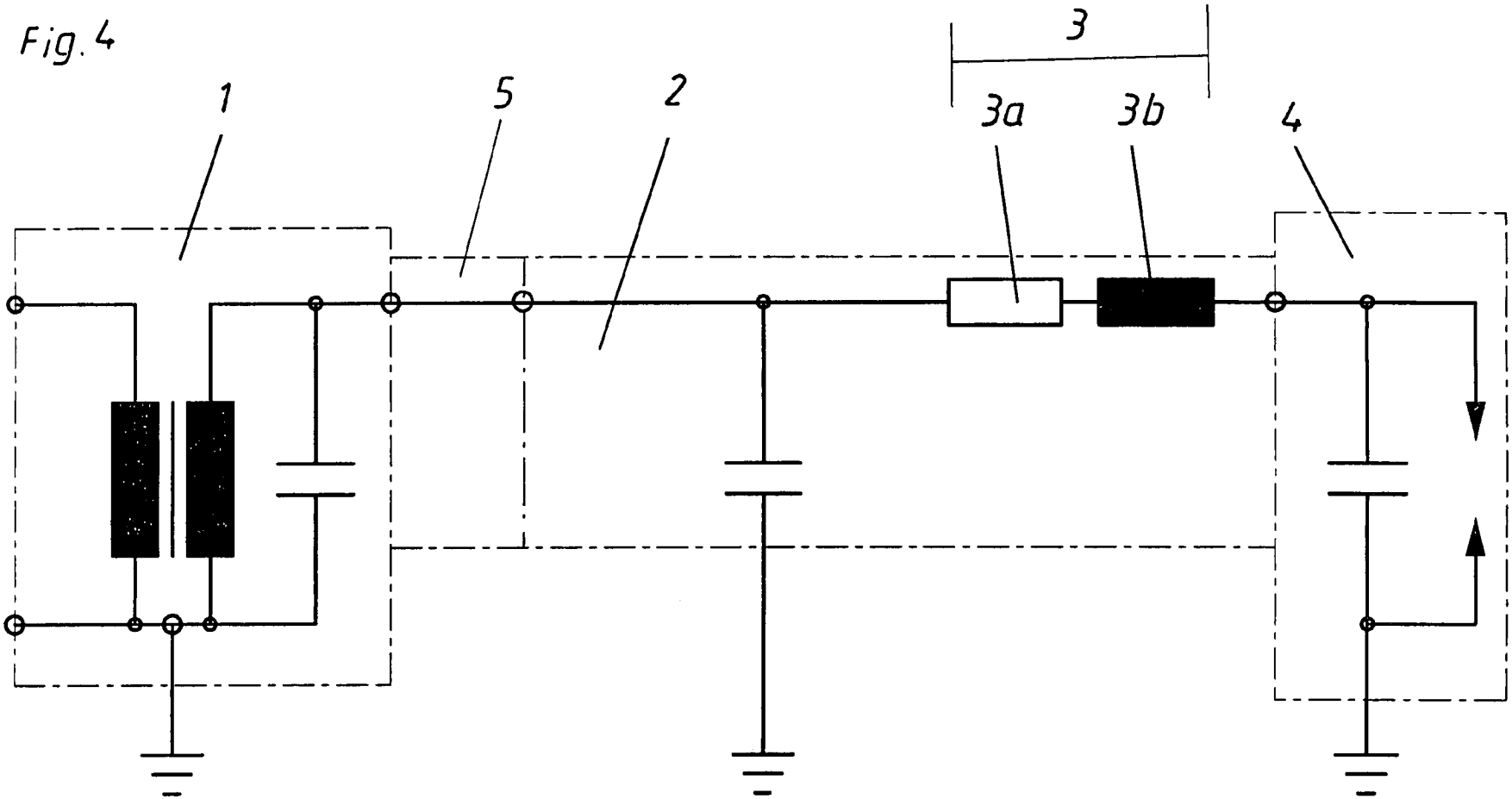
FIG. 4 is a schematic view of an equivalent electrical circuit.

FIG. 4 shows an equivalent electrical circuit diagram for the arrangement of the ignition coil 1, the spark plug connector 2 with inductive interference suppression device 3, and the spark plug 4. The ignition coil 1 and the spark plug connector 2, which is arranged separately from coil 1, are electrically connected to one another by way of the spark plug lead 5. The inductive interference suppression device 3 includes both the inductance **3*b* and the ohmic d.c. resistor 3*a*. The ohmic d.c. resistance of 20 Ωat 20° C. may be created and/or supplemented by an additional resistor component 3*a* connected in series, as illustrated in FIG. 4. However, it is more advantageous if the d.c. resistance is provided, preferably in its entirety, by the use of resistor wire for the coil or winding 13**.

The invention claimed is:

1. A spark plug connector comprising:

an inductive interference suppression device including a ferromagnetic core and at least one winding, said inductive interference suppression device having an ohmic direct current resistance of at least 20Ω at 20° C. and having an inductance of between 200 μH and 500 μH.

2. The spark plug connector of claim 1, wherein said inductive interference suppression device has an ohmic direct current resistance of at least 100Ω at 20° C.

3. The spark plug connector of claim 1, wherein said inductive interference suppression device has an ohmic direct current resistance of at least 500Ω at 20° C.

4. The spark plug connector of claim 1, wherein said at least one winding comprises a resistor wire for providing ohmic direct current resistance.

5. The spark plug connector of claim 1, further comprising a resistor component connected in series with said at least one winding.

6. The spark plug connector of claim 1, wherein said inductive interference suppression device further includes a resistor component connected in series with said at least one winding.

7. The spark plug connector of claim 1, further comprising a terminal contact for contacting a spark plug, said inductive interference suppression device being electrically connected as close as possible to said terminal contact.

8. The spark plug connector of claim 1, further comprising a terminal contact for contacting a spark plug, said inductive interference suppression device being electrically connected directly to said terminal contact.

9. The spark plug connector of claim 1, further comprising an ohmic direct current resistor, said ferromagnetic core, said at least one winding, and said ohmic direct current resistor being at least partly surrounded by a ceramic element.

10. The spark plug connector of claim 1, further comprising a terminal contact for contacting a spark plug, said inductive interference suppression device having a distal end remote from said terminal contact a plug, and further including at said distal end a plug, clamping, or screw connection device for contacting a spark plug lead at least partly guided inside said spark plug connector.

11. The spark plug connector of claim 1, wherein said ferromagnetic core includes ferrite.

12. The spark plug connector of claim 1, wherein said inductive interference suppression device has an inductance of between 300 μH and 400 μH.

13. The spark plug connector of claim 1, wherein said inductive interference suppression device is operable in a frequency range of between 1 MHz and 1 GHz.

14. The spark plug connector of claim 1, wherein said inductive interference suppression device is operable in a frequency range of between 30 MHz and 1 GHz.

15. The spark plug connector of claim 1, wherein said spark plug connector has an electric strength more than 10 kV.

16. The spark plug connector of claim 1, wherein said spark plug connector has an electric strength of more than 30 kV.

17. The spark plug connector of claim 1, wherein said spark plug connector has a length of at least 10 cm.

18. The spark plug connector of claim 1, wherein said spark plug connector has a length of between 40 cm and 70 cm.

19. The spark plug connector of claim 1, further comprising a terminal contact for contacting a spark plug, said spark plug connector having a distal end remote from said terminal contact and being located at least 10 cm away from a distal end of said inductive interference suppression device remote from said terminal contact.

20. The spark plug connector of claim 1, further comprising a terminal contact for contacting a spark plug, said spark plug connector having a distal end remote from said terminal contact being located between 40 cm and 70 cm away from a distal end of said inductive interference suppression device remote from said terminal contact.

21. The spark plug connector of claim 1, wherein said spark plug connector is substantially rigid.

22. The spark plug connector of claim 21, further comprising a support including polytetrafluoroethylene.

23. The spark plug connector of claim 1, wherein said spark plug connector is separate from an ignition coil.

24. The spark plug connector of claim 1, further comprising a support having a first end shaped and arranged to be connected to a spark plug, a second end opposite said first end, and a central bore between said first end and said second end, said inductive interference suppression device being arranged in said central bore.

25. The spark plug connector of claim 1, wherein said at least one winding has a coil.

26. The spark plug connector of claim 1, wherein said at least one winding is wound directly onto said ferromagnetic core.

27. An ignition system comprising:

an ignition coil having a spark plug lead;

a spark plug connector having a first end connected to an end of said spark plug lead and having a second end opposite said first end, said spark plug connector comprising an inductive interference suppression device including a ferromagnetic core and at least one winding, said inductive interference suppression device having an ohmic direct current resistance of at least 20Ω at 20° C. and having an inductance of between 200 μH and 500 μH; and a spark plug connected to said second end of said spark plug connector.

* * * * *